United States Patent [19]

Gerth

[11] 4,227,268

[45] Oct. 14, 1980

[54] CONVERTIBLE FURNITURE

[76] Inventor: William V. Gerth, 451 Phillip St., Waterloo, Ontario, Canada

[21] Appl. No.: 956,103

[22] Filed: Oct. 30, 1978

[51] Int. Cl.[2] ..... A47C 17/10

[52] U.S. Cl. ..... 5/13; 5/29

[58] Field of Search ..... 5/13, 27, 29, 37

[56] References Cited

U.S. PATENT DOCUMENTS

| | | | |
|---|---|---|---|
| 3,292,188 | 12/1966 | Gerth | 5/13 |
| 3,868,733 | 3/1975 | Spitz et al. | 5/13 |
| 4,080,672 | 3/1978 | Eakins | 5/13 |

*Primary Examiner*—Casmir A. Nunberg
*Attorney, Agent, or Firm*—K. Maxwell Hill

[57] ABSTRACT

A sofa bed has a multi-section bed assembly which is partly storable in the sofa back to become the back cushion support for the sofa and is partly storable sandwich-like in the seat cavity of the sofa to be the seat cushion support for the sofa thereby allowing the bottom of the sofa to be reduced in depth, back to front, permitting the structure to be moved through narrow doorways and the like not heretofore possible in convertible furniture.

1 Claim, 6 Drawing Figures

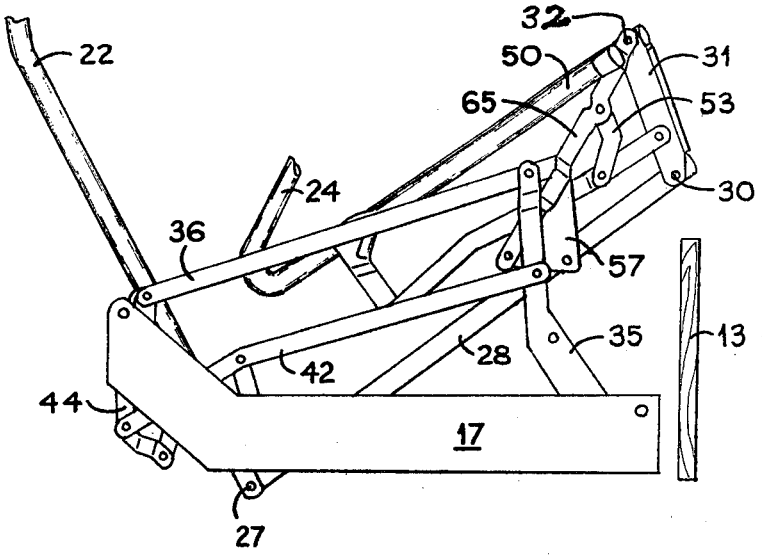
FIG. 2
FIG. 4
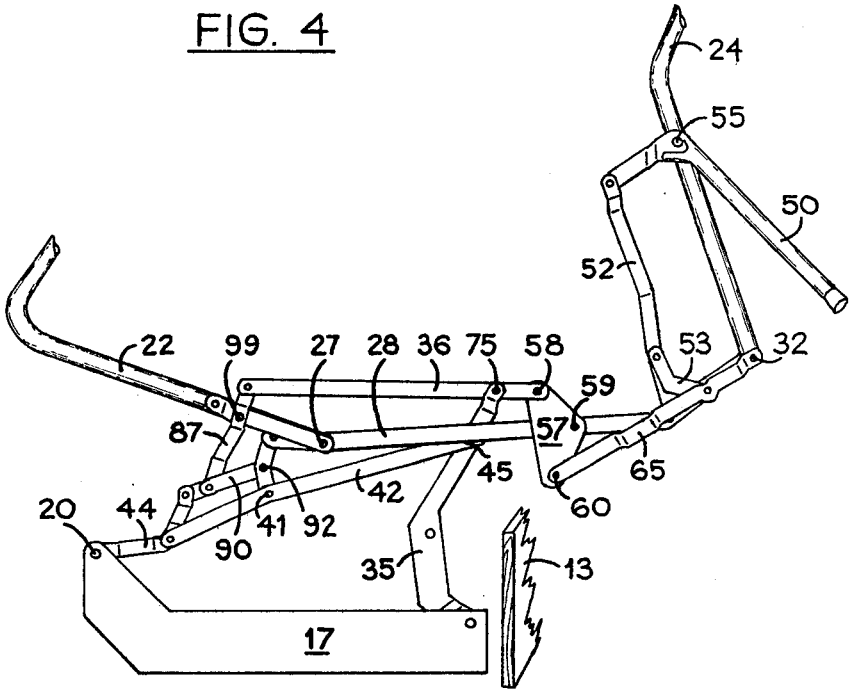

CONVERTIBLE FURNITURE

FIELD OF INVENTION

The present invention relates to sofa or chair type upholstered furniture designed to convert into a bed. In particular the invention herein comprises a mattress support means that is collapseable and storable within a sofa frame whereby the rear or inner part of the support means and mattress become the back rest support for the sofa thereby eliminating the need for a lower back sofa frame rail. Less depth of seat storage space is achieved in the present structure by having part of the bed store in the upper back of the sofa.

PRIOR ART

It is old to convert a sofa into a bed by hingeably folding the seat of the sofa at the juncture of the seat and backrest. It is also now old to provide a pull-out mattress and support mechanism from within the seat of the sofa with the mechanism folded at its mid-section to fit the seat cavity beneath the sofa cushions. It is known to make furniture adaptable for either a bed or a chair or sofa merely by providing folding legs and mattress support frames which are connected to swing link levers which allow the bed part of the structure to be pulled out in unfolding sequence from the seat cavity to create a bed pivotably attached to the sofa frame.

A major disadvantage of known sofa-beds is that they must be relatively deep from front to back in the seat and in the seat cavity to receive the whole of the folded bed, the mattress and the folding link mechanisms and legs. It must be at least one-half the length of an average adult bed with extra few inches for the unfolding mechanism to clear the back and front of the fixed part of the sofa frame. Since contemporary sofa design demands a low to the floor upper seat level profile appearance, the folding mechanism must be made to fold and store in a reduced cavity in the seat.

My U.S. Pat. No. 4,068,328 provides a sofa having a bed foldable and storable into the seat cavity including the part of the seat cavity below the lower back cross stuffing rail. A disadvantage of the structure disclosed by the above patent is that the linkages must operate and swing the bed downwardly and backwardly into the sofa seat cavity while clearing both the floor beneath the sofa and the back stuffing rail. My present invention, by eliminating the stuffing rail altogether has allowed the folding means to be simplified and has further allowed me to utilize the space behind the seat cushions for mattress storage.

Since the fold-in-half type of fold out bed-sofa requires more depth of storage space than a normal person requires for sitting in comfort, convertible furniture of the fold type must be deep at the bottom from back to front to accomadate a half length of bed (one half of 72" plus clearance room). It has been found that sofa-beds of the above kind cannot be used where they are to be placed in rooms having entrance doorways which are not of sufficient width to permit movement of the furniture into the room. Reduction of the back height may help but the requirement for storage of a half-bed at the bottom inhibits the manipulation of the structure around corners and through doorways as in plain sofas which have sloped backs with resulting narrower bottoms. The mechanism provided by the invention herein essentially folds the bed into three parts with one part folding into the back to become the cushion backrest for the sofa and the other two parts folding sandwich-like over one another to become the seat cushion support for the sofa. The outside bottom width of the sofa-bed herein described is reduced to the depth of an average sofa thereby allowing the structure to be passed through narrower passageways than heretofore.

OBJECTS OF THE INVENTION

It is the principal object of the present invention to provide a convertible bed-sofa wherein the bed is foldable into three major sections therby permitting it to store in a normal depth of sofa frame having a low profile appearance. It is a further object of this invention to provide a sofa-bed mechanism that allows part of the bed and its mattress to store when folded, beneath the front frame panel of the sofa while simultaneously employing another part of the bed assembly to act as the back cushion support for the sofa thereby eliminating the cushion support and lower cross stuffing rail of the sofa frame.

SUMMARY OF THE INVENTION

The above objects are achieved by providing pivot linkage to the bed mechanism to cause it to fold into three main sections and by removing the back cushion supports and cross stuffing rail of the sofa frame. A locking means is provided to the rear part of the folding mechanism to maintain the rear one-third portion of the bed frame when infolded, in a rigid upwardly and backwardly inclined position, thereby to serve as a cushion supporting backrest to the sofa while the other two parts of the bed are stored in overlying folded posture in the sofa frame seat cavity. The two forward overlying folded portions of the stored bed frame and mattress become the seat cushion support when in the stored posture.

A still further object of the invention is to create a unique locking mechanism within the bed folding linkage to permit the inner part of the three-fold bed to be folded upward and inward or downward and outward without touching the back of the sofa.

IN THE DRAWINGS

With the above objects in view the structure of the invention herein and the best mode of operating the mechanism described is exemplified in the accompanying drawings wherein like numerals refer to identical parts.

FIG. 2 shows a bed being initially lifted from the frame.

FIG. 4 is a later stage in the unfolding of the bed showing the back or head portion near the final bed position and the two outer parts being outfolded simultaneously with a leg.

THE PREFERRED EMBODIMENT

Figure 1:
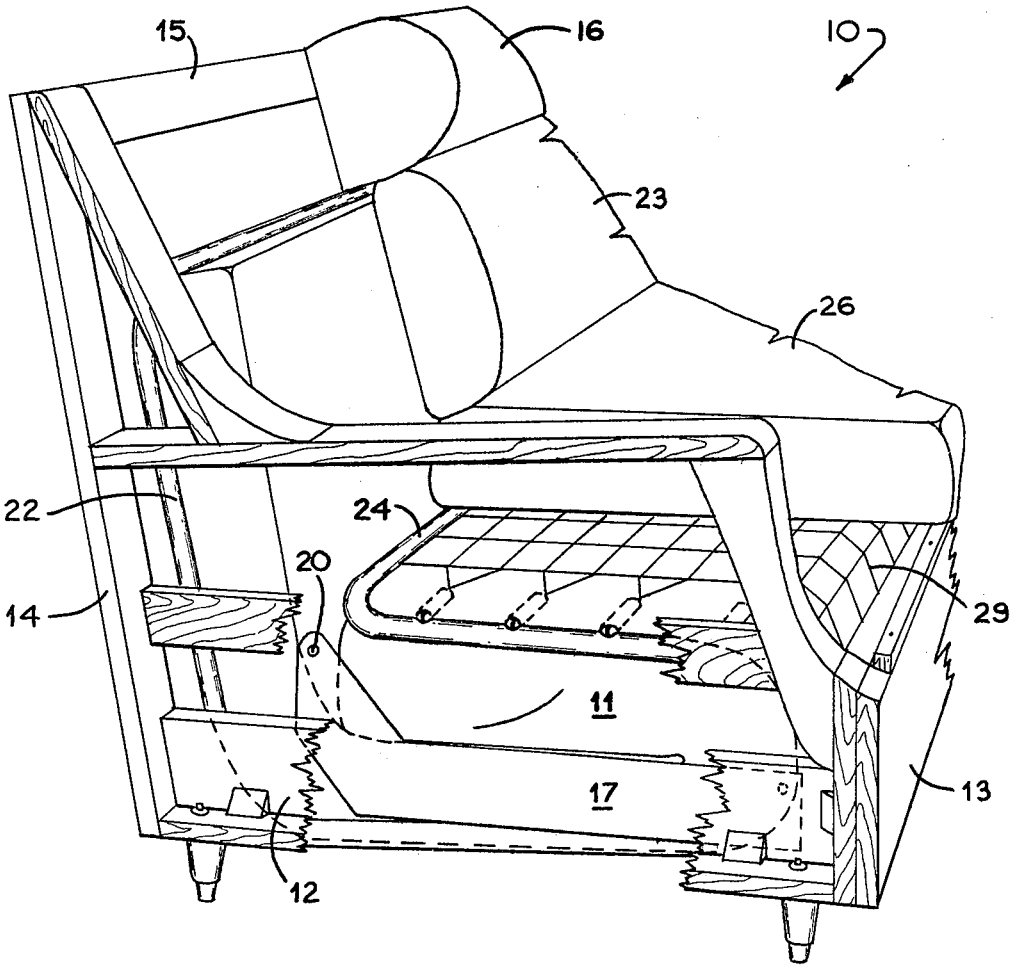
FIG. 1 is an end perspective view of a chesterfield with the bed and folding mechanism in the stored mode within the frame and the cushions shown partially covering and being supported by the folded bed.

In FIG. 1 sofa-bed 10 is depicted with an end frame member 12 connecting a front panel 13 to a back frame 14. A back cross upper rail 15 is shown supporting a fixed upper back 16. The bed mechanism 18 is attached to either end of a sofa frame by a pair of base plates 17. One end of the sofa frame is shown with one plate shown fixed to frame 12 but it will be understood that two identical mechanisms 18 are attached to identical plates 17.

The mechanism for folding and unfolding the mattress 11 and two of the mattress support frames 22,24 is pivotably attached to plate 17 at two pivot points 20, 21. Removeable back cushions 23 and seat cushions 26 are shown resting on the mattress 11 and the mattress support 29, respectively.

Figure 1A:
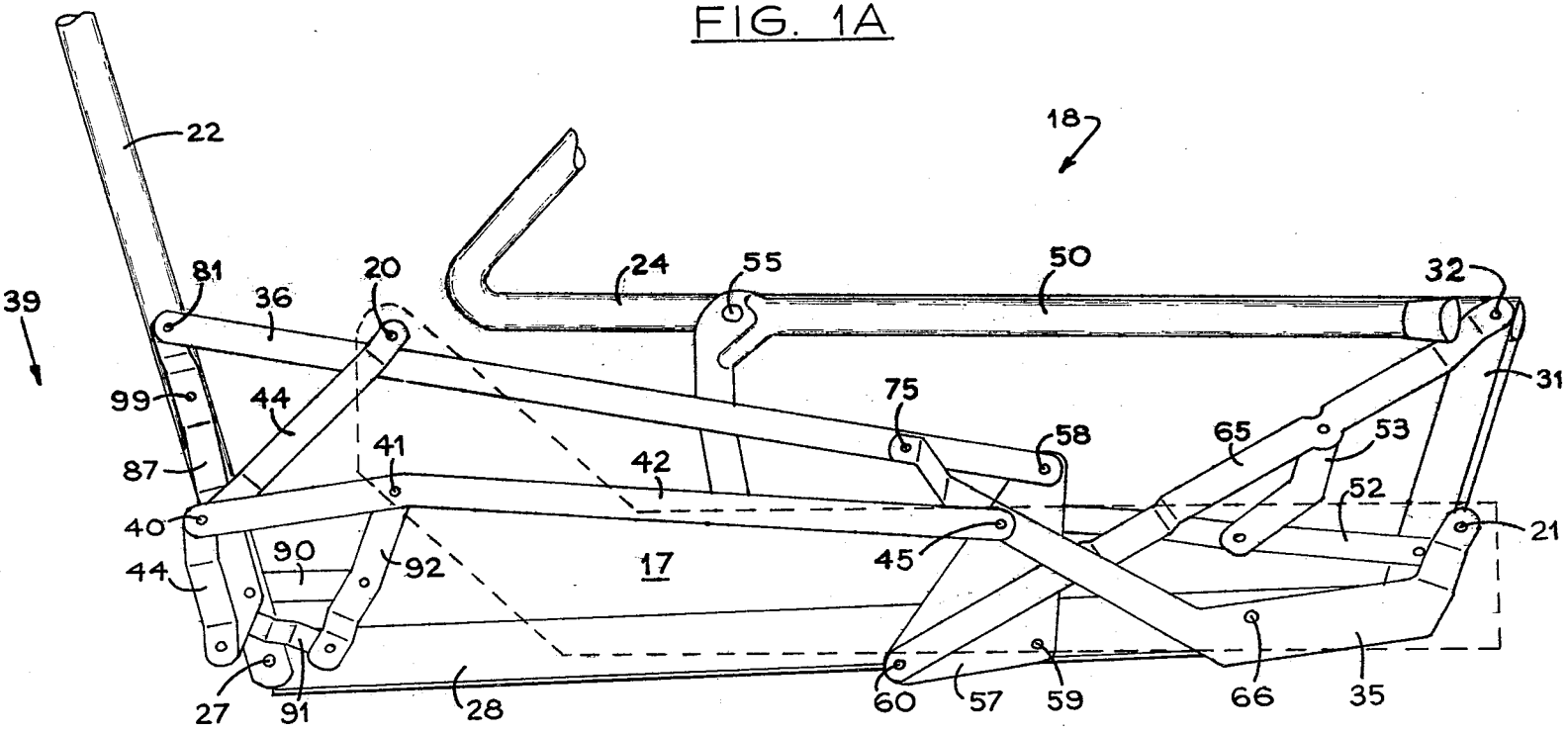
FIG. 1A is an enlarged view of the bed mechanism in the folded posture with a base frame attach plate in dotted line.

FIG. 1A shows the bed mechanism 18 consisting of the base plate 17 attached to the bottom of side frame 12 with the swing and fold linkages connected to the mattress support tubes 22, 24. Rear tube 22 upwardly curved at corners 25 (FIG. 5), holds the mattress in place to prevent it from creeping up into the cavity behind 16. A wire mesh mattress support 29 is connected between tube 24, mid link 28 tube 22 and channel 31 and identical tubes links and channel members of the mechanism supported on the other end of the sofa-bed not illustrated.

Tube 22 which is proximate the back of the sofa is pivotably attached at 27 to mid-link side angle 28 and link 28 is in turn pivotably linked at 30 to the short channel link 31 which connects at pivot 32 to the outer tube 24 to provide a four fold bed, or if the channel 31 is considered the fold between 28 and 24 of the seat support, a simple and novel tri-fold bed is hereby provided. Tubes 22 and 24 are U shaped having arms that form the top and foot of the bed and connect with the identical tubes on the other end of the bed where another mechanism 18 is disposed for operational union with the mechanism 18 shown by means of torsion bar connected at 66 to the 18 mechanism. For a chair bed only one set of 18 means need be provided with the tubes 24,22,and 28 of one side supported by folding legs and moved in union with the side having the swing mechanism 18.

A main mid upwardly thrusting compression lever 35 is pivotably attached to fixed plate 17 at 21. Lever 35 is pivotably attached at 75 to upper stabilizer arm 36 and is bowed outwardly from the sofa frame to give a forward angle lock when it is extended. The inner tube 22 locks backward as in FIG. 1A, at an angle of 20 degrees from the vertical, to make the rigid backrest for the sofa cushions 23. Tube 22 does not lock in back position until all the remaining links 24,28,31 with mattress therebetween, have been folded over and lowered into the seat cavity to become the seat.

The group of links designated numeral 39 provides the bracing to hold back tube 22 in the fixed upright position. The connection of lock links 92,91 at points 41 to arm 42 and through point 40 to link 44, gives the assembly 39 both the backward bracing and the compressive thrust to react as a leg to the back of the assembly 39. Cross link 42 is pivotably attached to main link 35 at 45 to give the bridging rigidity to the downward pressing mass of the bed when loaded. Link 42 becomes the main bridge between the sofa frame at 20 and lever 35 through the cross link 42, attached to rear swing link 44. It will be appreciated that the configuration of assembly of links 39 has been made to achieve the dual purpose of allowing the outfolding of the front structure to be done without striking the front panel 13 and also to make a lock for rear tube 22 when in the upward posture as a back rest. Another problem solved by assembly 39 is that pivot point 20 must be sufficiently above the folded links as shown in FIG. 1 to allow for the reversal of the swing links and while being below the upper level of the folded mattress to cause no unsightly show of mechanism when the unit is stored in the sofa. The assembly 39 is therefore, a unique structure achieving the designated purpose.

OPERATION OF LOCK ASSEMBLY 39.

Figure 3:
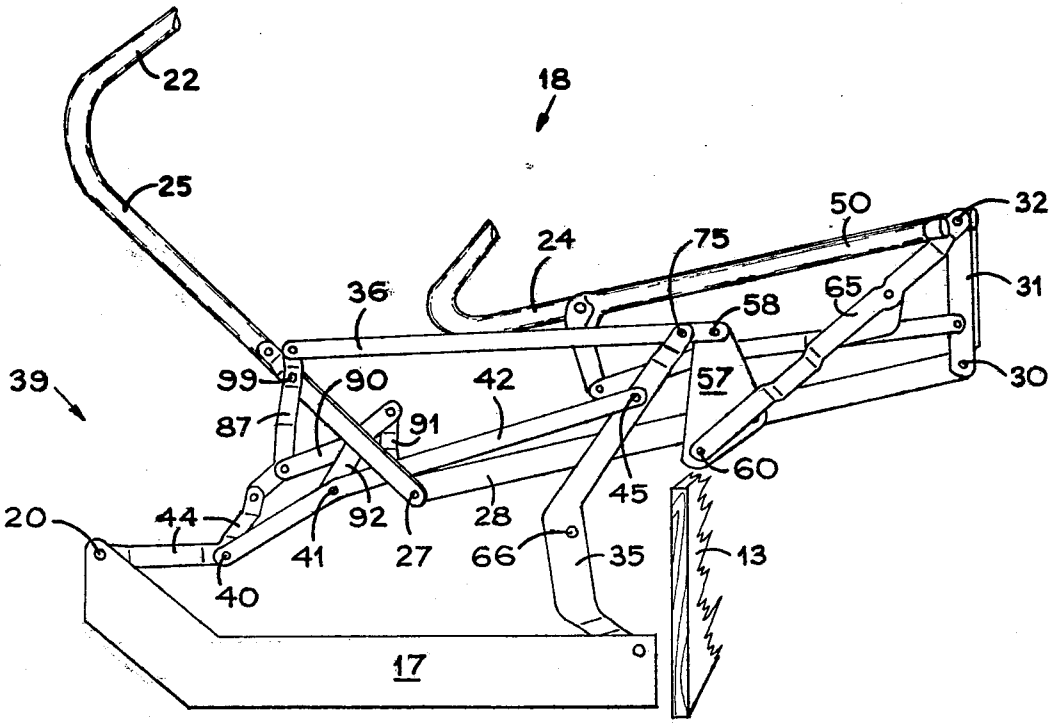
FIG. 3 shows the movement of the bed mechanism folding linkages proximate the sofa back being swung about their pivots to pull the bed down without touching the sofa back.

When the bed is in the folded and stored mode with the tube 22 operating as a backrest, the angle at 27 between 22 and mid tube 28 is greater than 90 degrees as in FIG. 1A. As main lever 35 is pulled up about its pivot 21 to have the bed clear the front panel 13, the angle between 22 and 28 must be reduced to less than 90 degrees to insure that tube 22 does not strike the back of the sofa frame (FIG. 2). However, once the point 30 of mid tube 28 clears the top edge of panel 13 the 22–28 angle can be allowed to open up to its ultimate 180 degree bed serving posture, with the back of 22 coming down and forward. The assembly 39 serves the above two step function as follows: V swing link 44 is attached at upper pivot point 20 to base plate 17. Main upper cross brace 36 is attached to tube 22 at 81 and to swing lever 57 at pivot point 58. The short link 91 is pivotably attached to the bottom end of tube 22 distant from the pivot point 81 of the link 36 attachment. Links 87,44 are initally folded into line with one another and along tube 22 as shown in FIG. 1A, with link 91 fixed to the bottom of 22 thereby locking the pivot point 27 of tubes 22 and 28 stationary by means of of the brace 42 to 35, until point 30 has cleared the front panel 13 when the back pull force of lever 65 through swing lever 57 draws brace 36 forward thereby opening out 87 and 44 into their inline position developing in the FIGS. 3 and 4 which also breaks the lock of the folded levers 44,87,91–92.

OPERATION OF THE FOLDING MEANS

The primary purpose of link 44 is to hold up the rear end of the assembly 39 and to eventualy hold up the bed as outfolded. The action of holding up the bed from frame 12 is carried through to tube 22 by link 87 and is braced to lever 35 by link 42.

Figure 5:
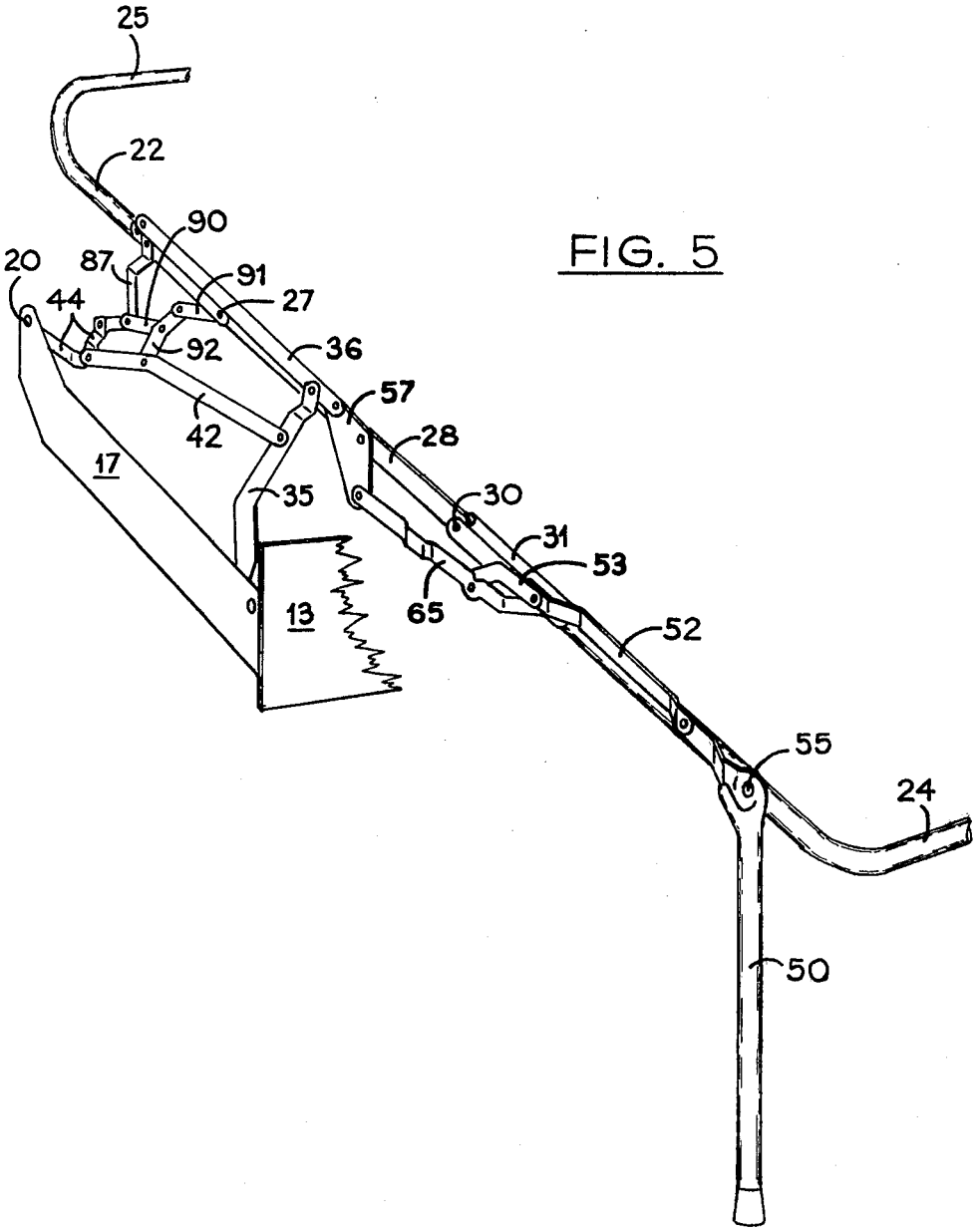
FIG. 5 is a perspective view of the outfolded bed mechanism of one side of the bed taken from the foot of one side thereof and showing the set of lock links pivoted about the base plate and the other lock links bridging the leg and outer foot of the bed frame with the mid section links.

The force of 65 controls the unfolding and collapsing of links 44,87 and through the movement of 87 carries link 90 up to brace the upper bed lock links 91–92 into position combining with the forward side of the bridge box 44,87 to keep the rear end of the bed from collapsing when outfolded. FIG. 5 shows how link 41 maintains the bridge-box in position. The thrust of a person lifting on the bed passes through link 36 toward the sofa back 16 breaks the box and allows the linkage to collapse into the back lock posture of FIG. 1A. During the movement 1A to 5 link 91 traces a 270 degree path. Swing lever 57 is attached at pivot 60 to ultimate lock lever 65. When 65 holds 57 forward no movement can occur in assembly 39. As long as 65–57 are below pivot point 32 there is over-centre locking of the levers which makes the assembly 39 secure until the forward end of the bed has cleared the panel 13.

During infolding the swing plate 57 allows link 36 to maintain 44,87 and assembly 39 in lock open mode until until tubes 22,28 pivot about 59 and begin their downward travel which travel action forces 36 forward at 58, which happens when 65 pulls 57 outward pivoting 57 on point 59.

A torsion bar (not shown) can be attached at point 66 to each main lever 35 on either side of the sofa to provide smooth and united movements to the pair of folding mechanisms 18 on the frames of the sofa.

Tube 22 is pivotable about 99 rather than at its bottom end to allow 91,92,90, to reduce the angle 22,28 at point 27, to less than 90 degrees for the period allowing the forward end of the bed to clear panel 13. The pivot point 27 must be taken up to the bed level while rear top of tube 22 remains closed to the back without touching it.

The linkage 90,91,92, would not be required if link 44 could be pivoted from a point high in the side or arm rest of the sofa. For appearance sake a link pivot above the seat level would not be acceptable to the user of the sofa. Links 44,87 are substantially the same length in order that distance 20–81 will be twice the distance of 20 to the floor beneath the sofa.

A leg 50 is pivotably attached at 55 to outer tube 24 and is also connected through links 52,53 to channel link 31 to cause the leg 50 to fold outwardly or inwardly with movement of frame 24 through the 180 degree arc from closed to open position. The swing lever 57 is pivotably connected at 58,59, and 60 to inner cross brace 36, mid-link 28 and lock lever 65 respectively, to allow smooth unfolding and infolding of frame 24 when a person pulls up or pushes down on frame 24 in the manipulation of the mechanism as a bed. Lever 57 and lock arm 65 and brace 36 provide the necessary rigidity to the bed, as heretofore discussed, to prevent the bed from collapsing into its three separate parts when loaded by prone persons.

When the tube 24 with its mesh mattress support provide a cushion and seat in the sofa mode, brace 65 link 53 and leg brace 52 with side channel 31 create, with the leg the braced truss structure required to hold the seated weight of a person without collapse. The weight of the seated person is carried through the levers 57 etc to the pivot points 21 and 20 to be distributed on the base plate and frame of the sofa.

What I claim as my invention is:

1. Improvements in convertible furniture comprising in combination; a frame structure having a pair of end members attached between a front panel and a back frame; a bed assembly comprising;

a rear section pivotably attached intermediate its length by a pair of pivotable swing links, to a rearward part of an upwardly extending part of a base plate fixed to said end member; said rear section being storable upwardly within a back part of said sofa frame and outwardly and downwardly moveable therefrom to provide when horizontally disposed the inward part of the convertible bed;

a mid section and a forward section foldable over one another with a mattress member therebetween and storable within said frame below said front panel and being upwardly and outwardly moveable together to provide, when horizontaly outfolded a mid part and the outward part of the convertible bed herein, said mid section being pivotably attached to said rear section and pivotably attachable to channel spacer members pivotably attached to said forward section;

support levers pivotably attachable between a forward part of said end members and first brace means, said support levers providing an upward thrust and a forward locking means to said bed assembly when in outfolded position and loaded with human occupants, by having in said position a forwardly disposed position;

said first brace is pivotably attached intermediate its length to said support lever and has a forward end linked intermediate the mid section and a rearward end linked to said rear section by one of said pair of swing levers, to maintain said rear section in an upwardly inclined position within the furniture frame until said mid section and attached forward section are pulled upwardly from out of the cavity formed in the sofa frame by the end members and the front panel, to thereby clear the upper edge of said front panel;

a pair of leg members pivotably attached forwardly of said forward section to maintain the bed assembly in horizontal plane when outfolded and loaded with occupants;

a box-like configuration of link means for locking said legs in an outfolded position when the assembly is outfolded, said box-like configuration serving to maintain the forward section in substantially level position when the assembly is in the stored position, to provide the seat support for the furniture when in use as a sofa;

and a rear section lock assembly for operational use when the bed assembly is in stored posture with said rear section extending upwardly but not substantially backwardly to maintain said mattress thereon and forwardly facing to provide a sofa occupants back support, and wherein the pivot point of the mid section and rear section is below the point of attachment of said pair of swing levers and said base plate, comprising a second brace means pivotably attachable between a point intermediate the length of said support lever and intermediate the one pair of swing levers attached to said base plate to maintain the other of said swing levers in alignment with said rear section, said second brace means providing with said first brace means with its attachment to the other of said swing levers and with the combination of the support lever, a bridge box for locking the rear section upwards to maintain the weight of a seated occupant.

* * * * *